United States Patent [19]

Harada

[11] 4,200,874

[45] Apr. 29, 1980

[54] CAR ANTENNA MOUNTING MEANS

[75] Inventor: Jiro Harada, Tokyo, Japan

[73] Assignee: Harada Industry Co., Ltd., Tokyo, Japan

[21] Appl. No.: 911,397

[22] Filed: Jun. 1, 1978

[30] Foreign Application Priority Data

Dec. 27, 1977 [JP] Japan ..... 52-159899

[51] Int. Cl.[2] ..... H01Q 1/32

[52] U.S. Cl. ..... 343/715; 343/749; 343/888; 343/900

[58] Field of Search ..... 343/711-715, 343/749, 750, 900, 887-889; 174/153 A

[56] References Cited

U.S. PATENT DOCUMENTS

| | | | |
|---|---|---|---|
| 2,953,630 | 9/1960 | Cejka | 343/901 |
| 3,852,757 | 12/1974 | Kaiser | 343/900 |
| 4,095,229 | 6/1978 | Elliott | 343/715 |

*Primary Examiner*—David K. Moore

*Attorney, Agent, or Firm*—Frishauf, Holtz, Goodman & Woodward

[57] ABSTRACT

Disclosed is a car antenna system which comprises a substantially cylindrical mounting base having a conductor fitted therein and penetrating a car body wall, a mounting member shifted along the mounting base and fixed, a fixing means formed of an insulating material shifted by the mounting member to fix the mounting base to the car body wall, a rod antenna element attached to the outside end of a conductive part of the mounting base, and a loading coil located inside the car body wall and connected between the conductive part and a cable led to a CB-wave transmitter-receiver whereby, the capacitance between the car body wall and the conductive part being lower as compared with a case in which the mounting member is not included.

7 Claims, 5 Drawing Figures

CAR ANTENNA MOUNTING MEANS

BACKGROUND OF THE INVENTION

This invention relates to an antenna system for vehicles or cars, more specifically to a car antenna system suitable for transmission and reception of radio waves at frequencies of nearly 27 MHz called citizens band waves (hereinafter referred to as CB waves).

In general, this type of antenna system is so constructed that the length of an antenna element may be equivalently equal to the quarter wavelength of the CB wave, the so called loading coil being attached to the bottom, middle, or top portion of a rod antenna element set up on a car body wall. Although necessary for the CB waves, the loading coil is not requisite for the reception of amplitude-modulated waves (AM waves) for frequency-modulated waves (FM waves) transmitted from broadcasting stations. Therefore, if the loading coil is attached to any projecting part of the antenna element outside the car body, it may be seen from the outside that the car is equipped with an expensive CB-wave transmitter or a CB set, sometimes inducing mischievous acts on the loading coil or stealing of the CB set.

Although such trouble may be eliminated by locating the loading coil inside the car body, there have hitherto been proposed no satisfactory means to attain this. The reason for such situation is that a generally used quarter-wave antenna element is so designed as to attain the largest current value and the smallest voltage value or zero at the grounding point, so the internal attachment of the loading coil will shift the zero voltage point and create in the vicinity of the car body wall a portion where the voltage is not zero. As a result, the existence of capacitance caused between the antenna element and the car body wall or the ground will substantially increase the dielectric loss of the antenna element, thereby reducing the radiation efficiency of the antenna.

FIG. 1A shows an outline of the construction of the prior art antenna element attached to a car body wall. As illustrated, the bottom end portion of an antenna element 100 is coupled to a conductor 102, the bottom end portion of which is firmly fitted in an insulator barrel 104. The insulator barrel 104 is fixed by a metallic lower mounting member 106 extending obliquely upward. In attaching the antenna element 100 to a car body wall 108, the antenna element 100 is inserted in an opening bored through the car body wall 108, and fitted from above with an upper mounting member 110 formed on an insulating material. When a metallic clamping nut 112 is screwed down on the conductor 102, the upper and lower mounting members 110 and 106 are moved so as to approach each other, securely holding the body wall 108 between. Thus, the antenna element 100 is firmly attached to the body wall 108. C4 designates a capacitance formed between the body wall 108 and the conductor 102 through the insulator barrel 104, while C5 designates a capacitance formed between the body wall 108 and the conductor 102 through the upper mounting member 110. In order to illustrate the capacitances C4 and C5, the sectional marks (batches) on the relevant members are partially omitted. This also applies to the cases of FIGS. 3A and 3B as mentioned later. FIG. 1B schematically shows that the capacitances C4 and C5 are produced between the body wall 108 and the conductor 102. According to such arrangement of the capacitances, the capacitance between the body wall 108 and the conductor 102 is equal to the sum of C4 and C5.

SUMMARY OF THE INVENTION

An object of this invention is to provide an antenna for CB-wave transmission and reception capable of duly effective operation with a loading coil located inside a car body.

In order to attain the above object, the antenna system of this invention comprises a mounting base having an electric insulator barrel and an electric conductor fitted in said insulator barrel along the longitudinal axis thereof, the mounting base penetrating a car body wall, a metallic mounting member fitted on the periphery of a portion of the insulator barrel protruding outward from the car body wall and capable of being longitudinally moved and fixed, a fixing means moved by the mounting member to fix the mounting base to the car body wall, a rod antenna element with the bottom end held by an end portion of the conductor of the mounting base protruding outward from the car body wall, and a loading coil disposed inside the car body wall, having one end connected with a conductive part of the mounting base and the other end connected with a CB-wave transmitter-receiver or transceiver, whereby the capacitance between the car body wall and the conductive part of the mounting base is connected in series by means of the mounting member and is lower as compared with a case in which the mounting member is not included.

According to the car antenna system with the aforementioned construction, the loading coil is located inside the car body wall and hidden from the outside, so that there may be prevented various losses and damage such as mischievous acts on the loading coil and stealing of the CB set in the car. Moreover, since the capacitance between the antenna element provided for the system, as well as the conductor connected therewith, and the car body wall is small, the dielectric loss caused in the antenna system may be restricted to a very low level, and the radiation efficiency may securely be maintained at a practical level without regard to the unevenness in assembly and mounting of the antenna system.

In a preferred embodiment of this invention, the fixing means includes a lower fitting means formed of a conductive material, disposed at an end portion of the insulator barrel of the insulator base which protrudes inside the car body wall and engaging the inside face of the car body wall, and an upper mounting means formed of an insulating material, inserted between the mounting member and the outside face of the car body wall, and forced down by the shift of the mounting member to hold the car body wall between itself and the lower fitting means and fix the mounting base to the car body wall. With such construction, the mounting base may easily be attached to the car body wall, the capacitance between the car body wall and the conductive part including the conductor inside the mounting base may be minimized, and the dielectric loss caused between the car body wall and the conductive part may be reduced to a quite low level.

According to another preferred embodiment of the invention, there is provided a capacitor connected in series with the loading coil and forming a filter for CB waves to allow the passage of CB waves only and to prevent the passage of FM and AM waves, in cooperation with the loading coil. By using the loading coil as the coil to form the filter, the number of parts are reduced as compared with the case in which the filter is separately provided, and the system may be made compact.

In still another preferred embodiment of the invention, there is provided a shielding case which encloses the loading coil and the filter for CB waves. With such shielding case, noises from the ignition plug and the like of the car may be prevented from penetrating into the filter portion to deteriorate the CB set.

In an additional embodiment of the invention, provided in the shielding case is a filter which is connected with the antenna element and allows only AM and FM waves received by the antenna element to pass and prevents the passage of CB waves. With such filter, the antenna system of the invention may be suitable not only for the transmission and reception of CB waves but for the reception of FM waves and AM waves.

According to a further additional embodiment of the invention, provided in the shielding case is a capacitor which is connected between the CB set side terminal of the filter and the ground and used for the impedance matching for CB waves. With this capacitor, the antenna element may easily be matched with a feeding cable connected therewith.

DESCRIPTION OF THE PREFERRED EMBODIMENTS

Figure 2:
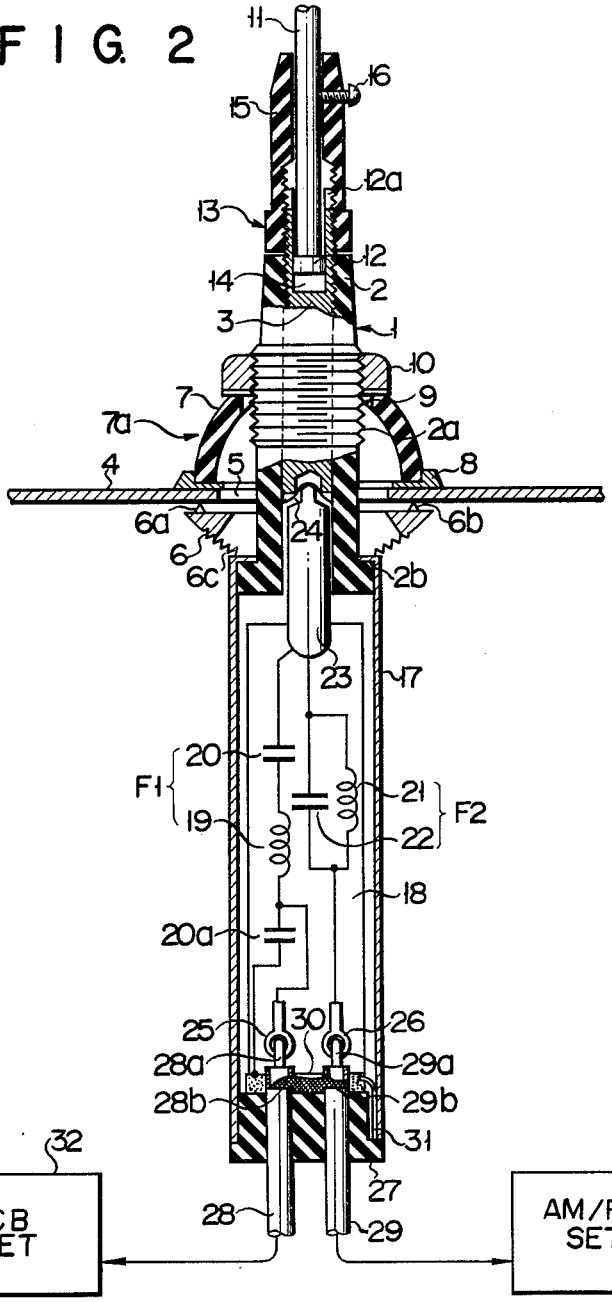
FIG. 2 is a partial sectional view of the car antenna system of this invention.

Referring now to FIG. 2, there is shown a mounting base 1 which includes a conductor 3 inserted in an insulator barrel 2. The insulator barrel 2 is formed of e.g. a synthetic resin in a substantially cylindrical shape. A threaded portion 2*a* is formed on the outer peripheral surface of the insulator barrel 2, while a flange portion 2*b* is provided at the bottom end (lower end as illustrated) of the insulator barrel 2. The conductor 3 is formed of a brass rod, for example, one end of which protrudes outward from the top of the insulator barrel 2. The other end of the conductor 3, fitted in the insulator barrel 2, is depressed inward from the bottom end portion of the insulator barrel 2. The mounting base 1 is passed through a mounting hole 5 bored through a car body wall 4, and a portion of the insulator barrel 2 is fixed to the car body wall 4 by means of a fixing element 7*a* composed of a lower mounting element 6 and an upper mounting element 7 and used as a fixing means. The lower mounting element 6 is formed of an electrically conductive material such as aluminum alloy, the bottom edge of the mounting element 6 being supported by the flange portion 2*b* of the insulator barrel 2 when the mounting element 6 is fitted on the outer periphery of the insulator barrel 2 of the mounting base 1. Formed on the arcuate bottom edge of the mounting element 6 are a plurality of serrated projections 6*c*. Formed on the flat top edge of the lower mounting element 6 are projections 6*a* and 6*b* so shapened as easily to bite into the back of the car body wall 6. The upper mounting element 7 is formed of a hard synthetic resin in a substantially hemispherical shape, fitting on the outer periphery of the insulator barrel 2 of the fitting base 1 which protrudes outward from the car body wall 4. The peripheral edge of the opening end of the upper mounted element 7 is joined with the surface of the car body wall 4 by means of a seat plate 8 formed of a flexible material such as rubber. Formed on the top of the upper mounting element 7 is a fitting hole 9 for setting the mounting base 1. A metallic fixing member or fixing nut 10 is screwed on the threaded portion 2*a* on the outer periphery of the insulator barrel 2 which protrudes outward from the upper mounting element 7 through the fitting hole 9. Therefore, when the fixing nut 10 is tightened, the mounting base 1 is forced relatively upward. As a result, the upper mounting element 7 is thrusted against the surface of the car body wall 4, whereas the lower mounting element 6 is pressed against the back of the car body wall 4. Thus, the mounting base 1 is fixed to the body wall 4.

Meanwhile, a bottom end portion 12 of an antenna element 11 is connected and fixed by means of an antenna element setting mechanism 13 to a portion of the conductor 3 inside the mounting base 1 further protruding upward from the position where the fixing nut 10 is engaged. The antenna element 11 is a rod antenna element which is formed of an electric conductor with a relatively small diameter. The bottom end portion 12 of the antenna element 11 has a diameter somewhat larger than the outside diameter of the rod portion. The antenna element setting mechanism 13 is provided, at the core near the top portion of the conductor 3, with a cylindrical hollow portion 14 to allow the bottom end portion 12 of the antenna element 11 to move a little in the axial direction. Further, the bottom end of a sleeve-like holding tube 15 is screwed on the outer periphery of the top portion of the conductor 3 so as to hold a portion of the antenna element 11 protruding outward from the conductor 3, the bottom end portion 12 of the antenna element 11 being fitted in the hollow portion 14. The opening of the hollow portion 14 has a diameter smaller than the inside diameter of the hollow portion 14, lest the bottom end portion 12 of the antenna element 11 should easily come off. In addition, the opening of the hollow portion 14 is provided with a slit 12*a*. The slit 12*a* gives elasticity to the opening so that the bottom end portion 12 of the antenna element 11 may be inserted into the hollow portion 14 through the opening when the holding tube 15 is not screwed on the conductor 3 and that the outer periphery of the rod of the antenna element 11 may be grasped and held by the opening when the holding tube 15 is screwed down on the conductor 3 after the bottom end portion 12 of the antenna element 11 is inserted into the hollow portion 14. Formed in the peripheral wall of the holding tube 15 is a tapped hole 16, in which a setscrew 16*a* is screwed from the outside. The setscrew 16*a*, when tightened, bites at the top end into the outer peripheral surface of the antenna element 11 inserted in the holding tube 15, thereby preventing the axial movement of the antenna element 11.

The flange portion 2*b* of the insulator barrel 2 of the mounting base 1, which protrudes inward or downward as illustrated from the car body wall 4, is fixed by the top end portion of a shielding case 17 formed of a conductive material such as aluminum by using the caulking method or the like. Accordingly, when the fixing nut 10 is tightened as aforesaid, the projections 6c formed on the arcuate bottom edge of the lower mounting element 6 bite into the top edge of the shielding case 17, electrically connecting the shielding case 17 with the lower mounting element 6. As a result, the shielding case 17 is electrically connected with the car body wall 4, a grounded conductor.

Contained in the shielding case 17 is a printed circuit 18, for example. The printed circuit 18 is provided with a first filter F1 for the passage of CB waves including a coil 19 connected in series with a capacitor 20 and a second filter F2 for the passage of AM and FM waves including a coil 21 connected in parallel with a capacitor 22. The coil 19 of the first filter F1 is an inductance element doubling as a loading coil. Each one of the first and second filters F1 and F2 is connected to a contact terminal 23 attached to the forward end or upper portion as illustrated of the printed circuit 18. The contact terminal 23 is formed of e.g. a brass rod, the tip end of which may be electrically connected with the bottom end portion of the conductor 3 retained inside the mounting base 1, by means of a conductive leaf spring 24. The other ends of the first and second filters F1 and F2 are connected with connecting terminals 25 and 26 attached to the bottom end of the printed circuit 18, respectively. An insulator 28 fitted in the bottom-end opening of the shielding case 17 closes the opening and mechanically sustains the bottom end of the printed circuit 18. A core wire 28a of a first cable 28 introduced into the shielding case 17 through the insulator 27 is connected to the connecting terminal 25. Likewise, a core wire 29a of a second cable 29 introduced into the shielding case 17 through the insulator 27 is connected to the connecting terminal 26. Grounding braided wires 28b and 29b of the first and second cables 28 and 29 introduced into the shielding case 17 are connected in common with a grounding conductor film 30 formed at the bottom end of the printed circuit 18. Connected between the connecting terminal 25 and the grounding conductor film 30 is a capacitor 20a for impedance matching. One end of the grounding conductor film 30 is connected with the shielding case 17 by means of a lead wire 31. The lead wire 31 is fitted in a groove formed on the peripheral surface of the insulator 27. In fitting the insulator 27 in the bottom-end opening of the shielding case 17, the lead wire 31 in the groove is pressed against the inside face of the shielding case 17, whereby the lead wire 31 is connected with the case 17. The tip end of the first cable 28 led out of the shielding case 17 is connected to a CB set 32, while the tip end of the second cable 29 led out of the case 17 is connected to an AM/FM set 33. For the first cable 28, for example, a coaxial cable with a characteristic impedance of 50Ω is used so as to obtain matching between the impedance at the input-output terminal of the CB set 32 and the impedance on the antenna element side. For the second cable 29, there is used a coaxial cable with a characteristic impedance suitable for the matching between the impedance at the input terminal of the AM/FM set 33 and the impedance on the antenna element side.

Figure 3A:
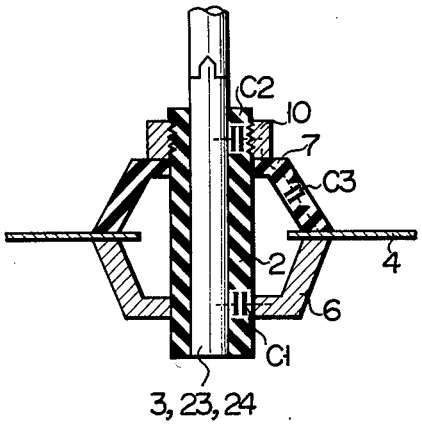
FIG. 3A shows the capacitance distribution between an antenna element side conductor and the car body wall according to the embodiment of FIG. 2.
Figure 3B:
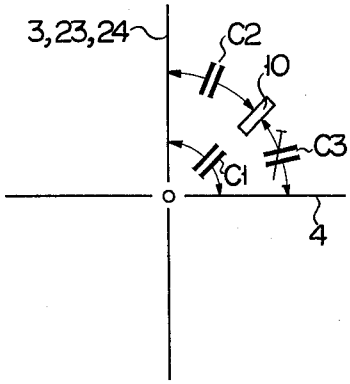
FIG. 3B is an equivalent circuit showing the capacitance distribution of FIG. 3A.

In thus constructed antenna system of the invention, the insulator barrel 2 forming the mounting base 1 is interposed between the conductors on the antenna element side (antenna element 11, conductor 3, contact terminal 23, etc.) and the car body wall 4, so that three capacitances C1, C2 and C3 are to exist between the antenna element side conductors 3, 23 and 24 and the car body wall 4 and fixing nut 10, as may be clear from FIG. 3A. Although FIG. 3A is a sectional view, hatches around the signs to designate the capacitances C1 to C3 are partially omitted in order to clarify the locations of the capacitances C1 to C3. FIG. 3B equivalently shows the capacitance distribution of FIG. 3A. Since the value of the capacitance C3 varies with the tightening force of the fixing nut 10, the capacitance C3 is shown as a halffixed variable capacitor.

Comparing the capacitance distribution between FIGS. 3B and 1B, it may be found that the capacitance between the antenna element side conductive parts, including the conductor, and the car body wall is smaller in the case of the antenna element setting mechanism used for this invention (FIG. 3B) as compared with the case of the prior art setting mechanism as mentioned before (FIG. 1B). It is so because the capacity between the car body wall (4, 108) and the metallic part (3, 23, 24; 102) connected to the antenna element, above the car body wall (4, 108), attains a value obtained by the series connection of two capacitances C3 and C2 owing to the existence of the fixing nut 10 in the case of FIG. 3B, whereas such capacitance becomes a single capacitance C5 in the case of FIG. 1B. In this case, the capacitance existing below the car body wall is C1 (FIG. 3B) or C4 (FIG. 1B), usually having a substantially equal value, as may be seen from FIGS. 3A and 1A.

Figure 1A:
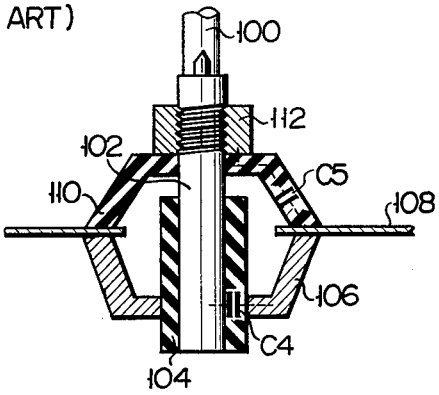
FIG. 1a (PRIOR ART)
FIG. 1A shows an antenna element of a prior art car antenna system attached to a car body wall.
Figure 1B:
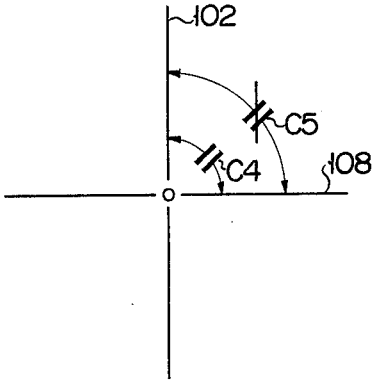
FIG. 1b (PRIOR ART)
FIG. 1B is an equivalent circuit showing the capacitance distribution between the car body wall and a conductor according to the attaching method of FIG. 1A.

As shown in FIGS. 3A and 1A, C3 of FIG. 3B has a value substantially equal to that of C5 of FIG. 1B, whereas C2 of FIG. 3B has a relatively smaller value.

From this point of view, the total capacitance between the metallic part connected to the antenna element and the car body wall is $$C1 + \frac{C2 \times C3}{C2 + C3} = C10$$

in the case of FIG. 3B, while it is $$C4 + C5 = 20$$

in the case of FIG. 1B, Here $$C5 >> \frac{C2 \times C3}{C2 + C3},$$

so that we obtain C10<<C20.

In the aforementioned construction that has conventionally been proposed, the value of C5 may substantially vary with the tightening force of the fixing nut 112. As for the capacitance C3 as shown in FIGS. 3A and 3B, it varies little because the fixing nut 10 is insulated from the conductors on the antenna element side. In addition, the capacitance value of C2 is kept substantially at a fixed level independently of the tightening force of the fixing nut 10, and C2 is connected in series with C3, so that there may hardly be caused any variation in the capacitance value.

Thus, in the system of the invention, the capacitance between the antenna and the ground will be very small and stable. Since the loading coil is located inside the car body wall, the dielectric loss will not increase but be substantially at the same level as the case of the prior art system in which the voltage is the lowest in the vicinity of the car body wall, even though the voltage on the antenna element is not zero in the region where the car body wall exists. Accordingly, the radiation efficiency of the antenna will never be reduced, and there may be secured a substantially fixed radiation efficiency.

Moreover, according to the system of the invention, the loading coil is concurrently used as the choke coil 19 of the filter F1 in a wave divider, so that the overall size of the antenna system is reduced. Integrally contained in the shielding case 17, the first and second filters F1 and F2 will not be exposed to any noises from engine components such as an ignition plug.

Furthermore, in the aforesaid system, the bottom end portion 12 of the antenna element 11 is inserted in the hollow portion 14 with a narrowed opening, the whole body of the antenna element 11 will be prevented from coming off the mounting base 1 even if the screw **16*a* for setting the axial location of the antenna element 11 falls out due to vibration or the like. Thus, if the set-screw 16*a* falls out while the car is running on a highway at a high speed, for example, there will be prevented accidents by scattering of the antenna element 11**.

The antenna system of this invention is not limited to the aformentioned embodiment. Although the loading coil is also used as the coil of the filter in the above embodiment, it is to be understood that the loading coil may be separately provided if there is room therefor. Further, the circuit elements such as the first and second filters are arranged on the printed circuit in the aforesaid embodiment, which is not, however, always required. The essential thing is that a measure be taken to contain the circuit elements compactly in the relatively narrow shielding case. Moreover, in the above embodiment, the nut 10 is screwed directly on the threaded portion **2*a* formed on the peripheral surface of the insulator barrel 2. In order to increase the mechanical strength, however, the surface of the threaded portion 2*a*** alone may be locally plated. It is to be understood that various changes and modifications besides those described herein may be effected by one skilled in the art without departing from the scope and spirit of the invention.

Thus, according to this invention, there may be provided a car antenna system with various advantages. That is, the loading coil is located inside the car body, the CB wave transmitting and receiving function of the antenna cannot be found out from the outside, preventing the expensive wireless apparatus from being stolen. Moreover, since the capacitance between the antenna element side conductors and the car body wall is small, and will hardly vary with the tightening force of the fixing nut used in attaching the antenna system to the cary body wall, so the dielectric loss of the antenna system may securely be restricted to a quite low level, the radiation efficiency being securely maintained at a practical level. In addition, as the filter of the wave separator is contained together with the loading coil in the shielding case, the antenna system may be made compact and free from the influence of noises from the ignition plug of the engine and the like.

What is claimed is:

1. An antenna system for mounting to a car body wall with a low capacitance between a central conductor of the antenna and the car body wall, comprising:

a mounting base having a cylindrical electrical insulator and a conductor fitted in said insulator, the cylindrical insulator extending from within a car body to outside the car body through an opening in a car body wall, the cylindrical insulator having a flange portion at the end portion thereof positioned within the car body and a threaded portion formed on the outer wall at the end portion thereof positioned outside the car body;

a metallic fixing nut threadably engaged with the threaded portion of the cylindrical insulator, the cylindrical insulator electrically isolating the fixing nut from the conductor of the mounting base;

an upper mounting element comprising an electrically insulating elastic material located outside the car body and disposed between the fixing nut and the car body wall and electrically isolating the fixing nut from the car body wall;

a metallic lower mounting element located inside the car body and disposed between the flange portion of the cylindrical insulator and the car body wall for fixing the mounting base to the car body wall in accordance with driving force of the fixing nut;

a rod antenna element mounted to that portion of the mounting base which is positioned outside the car body, the rod antenna element being electrically connected to the conductor of the mounting base;

a connecting terminal for a CB transceiver electrically connected to the rod antenna element; and a loading coil for CB radio waves disposed within the car body wall and wall and connected between the conductor of the mounting base and the CB transceiver connecting terminal.

2. An antenna system according to claim 1 wherein said opening in the car body wall through which the cylindrical insulator extends is substantially larger than the cross-sectional area of the conductor of the mounting base.

3. An antenna system according to claim 1 further comprising a capacitor connected in series with said loading coil and forming with said loading coil a filter to allow the passage of CB waves only in cooperation with said loading coil.

4. An antenna system according to claim 3 further comprising an electrically conducting shielding case enclosing said loading coil and filter.

5. An antenna system according to claim 4 further comprising a capacitor for impedance matching for CB radio waves connected in said shielding case between the CB set side terminal of said filter and ground.

6. A car antenna system according to either of claims 3 or 5 further comprising a further filter formed of a parallel circuit of a further coil and a further capacitor and having one end connected with the conductor of the mounting base and the other end connected with an AM/FM set, th filter permitting AM and FM radio waves to pass therethrough and prohibiting CB radio waves from passing therethrough.

7. An antenna system according to claim 1 wherein said opening in the car body wall through which the cylindrical insulator extends is substantially larger than the diameter of the cylindrical insulator so that a substantial clearance is provided between the cylindrical insulator and the car body wall.

* * * * *